US012604969B1

(12) United States Patent
Lv

(10) Patent No.: US 12,604,969 B1
(45) Date of Patent: Apr. 21, 2026

(54) MOSQUITO-REPELLING COVER FOR OUTDOOR HAMMOCK

(71) Applicant: Jinyun Sentu Outdoors Equipment Co., Ltd., Zhejiang (CN)

(72) Inventor: Liqiang Lv, Zhejiang (CN)

(73) Assignee: Jinyun Sentu Outdoors Equipment Co., Ltd., Zhejiang (CN)

( * ) Notice: Subject to any disclaimer, the term of this patent is extended or adjusted under 35 U.S.C. 154(b) by 0 days.

(21) Appl. No.: 19/321,465

(22) Filed: Sep. 8, 2025

(51) Int. Cl.
*A45F 3/52* (2006.01)
*A45F 3/22* (2006.01)

(52) U.S. Cl.
CPC . *A45F 3/52* (2013.01); *A45F 3/22* (2013.01)

(58) Field of Classification Search
CPC ..... A45F 3/22
USPC ..... 5/121
See application file for complete search history.

(56) References Cited

U.S. PATENT DOCUMENTS 326,321 A * 9/1885 Nickerson ..... A45F 3/22 5/121
495,366 A * 4/1893 Perry ..... A45F 3/22 5/121
8,356,370 B1 * 1/2013 Clark ..... A45F 3/24 5/120
12,082,682 B1 * 9/2024 Zheng ..... A45F 3/52

FOREIGN PATENT DOCUMENTS

CN 213604979 U * 7/2021
CN 222955038 U * 6/2025
CN 222997540 U * 6/2025
GB 2448006 A * 10/2008 ..... A45F 3/22
KR 101573382 B1 * 12/2015 ..... A45F 3/22
KR 20190111516 A * 10/2019 ..... A45F 3/52

* cited by examiner

*Primary Examiner* — Eric J Kurilla

(74) *Attorney, Agent, or Firm* — Hawaii Patent Services; Nathaniel K. Fedde; Kenton N. Fedde

(57) ABSTRACT

The present disclosure relates to a mosquito-repelling cover for an outdoor hammock, comprising a detachable mosquito-repelling cover, preset rigid supporting members, and connecting fasteners located at the hammock's load-bearing points. The supporting members maintain an even spacing between the mosquito-repelling cover and the hammock to widen the activity space, while the connecting fasteners create a rigid constraint between the supporting members and the hammock to limit lateral displacement and prevent tipping. The mosquito-repelling cover is designed with reversible upper and lower net sections to adapt to various scenarios.

17 Claims, 7 Drawing Sheets

MOSQUITO-REPELLING COVER FOR OUTDOOR HAMMOCK

TECHNICAL FIELD

The present disclosure relates to the technical field of outdoor equipment, particularly to a mosquito-repelling cover for an outdoor hammock.

BACKGROUND

In outdoor camping and similar scenarios, hammocks are widely used due to their portability and comfort, leading to the development of mosquito-repelling covers for hammocks. The original design intent was to use a mesh cover to block insects, creating a pest-free resting environment for users. However, existing hammock mosquito-repelling covers are limited by structural design, resulting in a plurality of issues that affect usability and safety: On one hand, most existing covers are positioned above the hammock, causing the bottom of the mesh to lie flat against the bearing surface of the hammock body when installed. When a user lies down, their torso presses tightly against the mesh, allowing insects to invade through gaps or bite through the mesh due to insufficient density or deformation under pressure, significantly compromising the core mosquito-repelling function. On the other hand, most existing covers rely on the flexible suspension of the mesh itself to maintain shape, resulting in a low, cramped interior space resembling a "mosquito net bag." Users frequently brush against the mesh when turning over or sitting up, creating a strong sense of confinement and completely undermining the relaxing experience a hammock should provide. Additionally, existing covers are typically attached to the hammock through simple hooks or full enclosures. When users move on the hammock, this can easily shift the hammock's center of gravity. In such cases, the mosquito-repelling cover not only fails to stabilize the hammock but may even worsen the imbalance due to localized pulling, increasing the risk of tipping and posing a safety hazard to users.

SUMMARY

The present disclosure provides a mosquito-repelling cover for an outdoor hammock to address the issues outlined in the background.

To achieve the above object, the present disclosure adopts the following technical solution:

A mosquito-repelling cover for an outdoor hammock a mosquito-repelling cover sleeved over a peripheral side of a hammock body; at least one supporting member fixedly connected to the mosquito-repelling cover; and a plurality of connecting fasteners fixedly connected to the mosquito-repelling cover and detachably connected to the hammock body. The at least one supporting member is configured to support an interval space between the mosquito-repelling cover and the hammock body when the mosquito-repelling cover is sleeved over the hammock body, preventing the mosquito-repelling cover from contacting a bearing surface of the hammock body. The plurality of connecting fasteners detachably connect the mosquito-repelling cover to the hammock body at discrete connection points distributed around the periphery of the hammock body, restraining lateral movement of the hammock body relative to the mosquito-repelling cover during connection.

A mosquito-repelling cover for outdoor hammock comprises a mosquito-repelling cover sleeved over a peripheral side of a hammock body; at least one supporting member configured as a rigid annular support frame, the supporting member being fixedly connected to the mosquito-repelling cover; and a plurality of connecting fasteners fixedly connected to the mosquito-repelling cover and detachably connected to the hammock body. The at least one supporting member is configured to support an interval space between the mosquito-repelling cover and the hammock body when the mosquito-repelling cover is sleeved over the hammock body, preventing the mosquito-repelling cover from contacting the bearing surface of the hammock body. The plurality of connecting fasteners are configured to detachably connect the mosquito-repelling cover to the hammock body at a plurality of discrete connection points distributed around a periphery of the hammock body to restrain lateral movement of the hammock body relative to the mosquito-repelling cover during connection.

A mosquito-repelling cover for outdoor hammock comprises: a mosquito-repelling cover sleeved over a peripheral side of the hammock body; at least one supporting member configured as a rigid semi-annular support frame, the supporting member being fixedly connected to the mosquito-repelling cover; and a plurality of connecting fasteners fixedly connected to the mosquito-repelling cover and detachably connected to the hammock body. The at least one supporting member is configured to support an interval space between the mosquito-repelling cover and the hammock body when the mosquito-repelling cover is sleeved over the hammock body, preventing the mosquito-repelling cover from contacting a bearing surface of the hammock body. The plurality of connecting fasteners are configured to detachably connect the mosquito-repelling cover to the hammock body at a plurality of discrete connection points distributed around a periphery of the periphery of the hammock body to restrain lateral movement of the hammock body relative to the mosquito-repelling cover during connection.

The beneficial effects of the present disclosure compared to the prior art are as follows:

Through the detachable inner and outer sleeving structure of the mosquito-repelling cover and the hammock body, combined with the supporting effect of the supporting member, an evenly spaced interval space is formed below the hammock, preventing the two from adhering due to their own weight or user pressure. This not only blocks mosquito bites from the air but also prevents ground-dwelling pests like snakes, insects, and ants from intruding, achieving comprehensive protection. By arranging connecting fasteners (lightweight rigid fixation clamps) at the four corners of the hammock body, a rigid constraint relationship between the hammock body and the supporting member is established, limiting lateral displacement of the hammock and preventing tipping, thereby enhancing stability. The split design of the upper net section and lower net section, along with multi-material options (waterproof/light-blocking/transparent/wear-resistant materials), combined with the 180° flipping function of the mosquito-repelling cover around the hammock axis, adapts to various weather scenarios such as rain protection, sunshade, and scenic viewing. The semicircular installation channel, compatible with the semicircular supporting member, allows the supporting member to be removed, enabling the mosquito-repelling cover to be folded completely, significantly reducing storage volume and improving portability for outdoor use. Meanwhile, the widening space divided by the supporting member corresponds to the main usage area of the hammock, ensuring ample room for users to turn or sit up, eliminating spatial constraints and enhancing comfort.

BRIEF DESCRIPTION OF DRAWINGS

The drawings, which form part of this application, are provided to further illustrate the present disclosure. The illustrative embodiments and their descriptions are intended to explain the present disclosure and do not constitute undue limitations. In the drawings.

Figure 1:
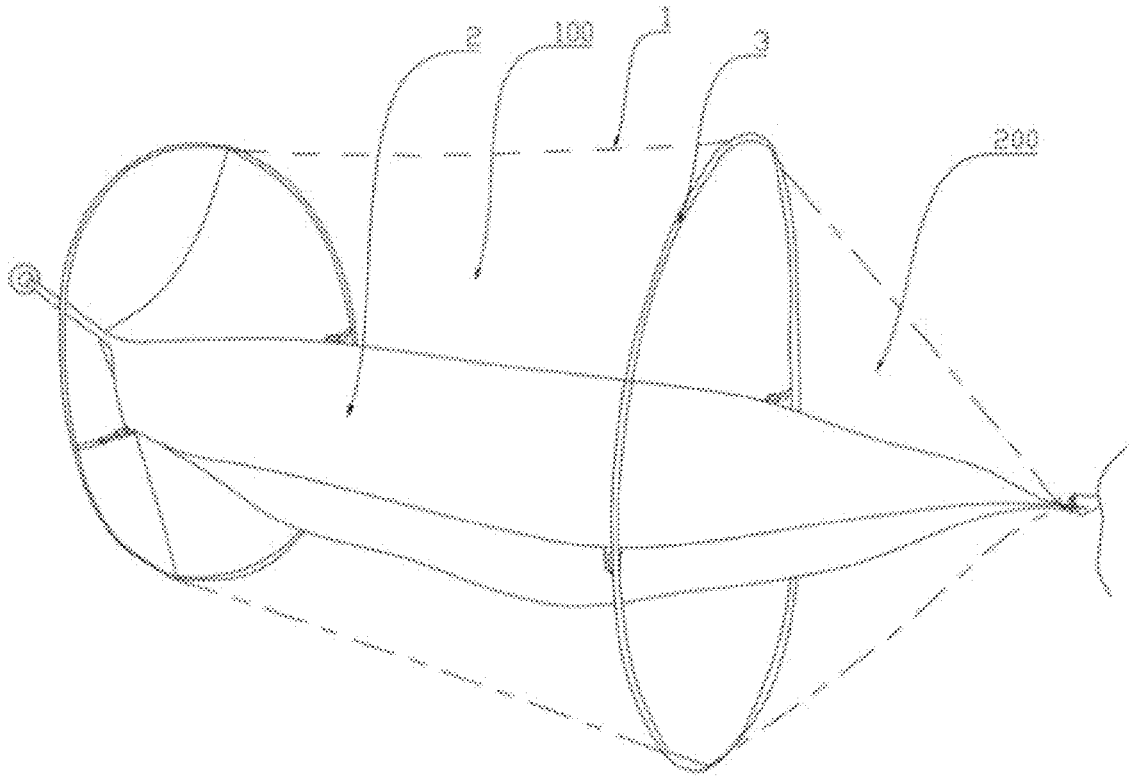
FIG. 1 is a perspective view of an embodiment provided by the present disclosure.

Reference signs: Mosquito-repelling cover for an outdoor hammock (10); Mosquito-repelling cover (1); Hammock body (2); Supporting member (3); Connecting fastener (4); Support frame (5); Upper net section (11); Lower net section (12); Installation channel (31); Widening space (100); Narrowing space (200); Protective space (300).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

Therefore, once an item is defined in one drawing, it may not require further discussion in subsequent drawings.

In the present disclosure, to address the technical shortcomings of existing mosquito-repelling covers for hammocks-such as the bottom easily adhering to the bearing surface of the hammock body, leading to failure of mosquito protection; reliance on flexible suspension, resulting in cramped internal space and a sense of confinement; and the hammock's tendency to tip over-a mosquito-repelling cover for an outdoor hammock is provided. This mosquito-repelling cover combines the structural integration of the mosquito-repelling cover, hammock body, supporting member, and connecting fastener, along with a split design of the upper net section and lower net section, achieving all-around protection, space expansion, and anti-tipping functions in one. Below, the specific implementation of the mosquito-repelling cover for an outdoor hammock according to the present disclosure will be described in detail with reference to the accompanying drawings.

Figure 4:
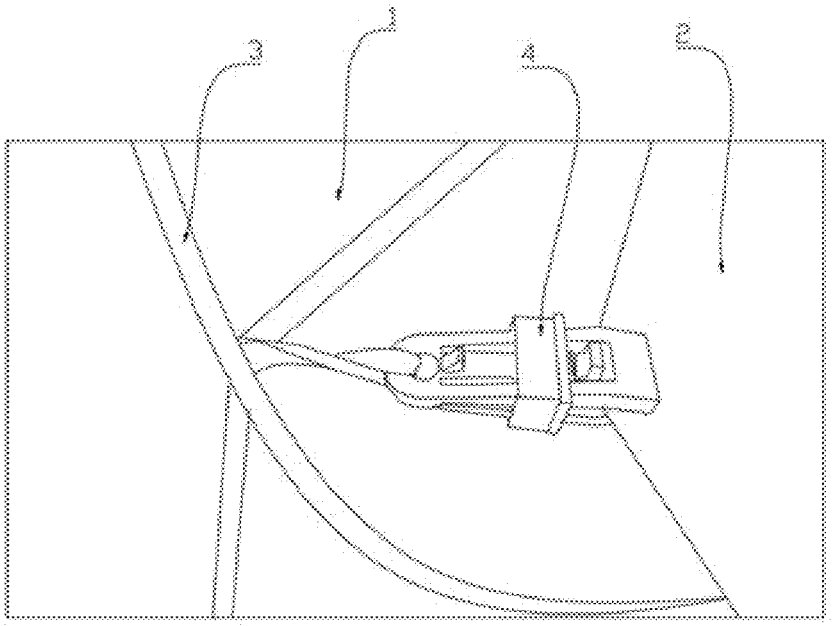
FIG. 4 is a connection schematic of the connecting fastener in the embodiment shown in FIG. 1.
Figure 5:
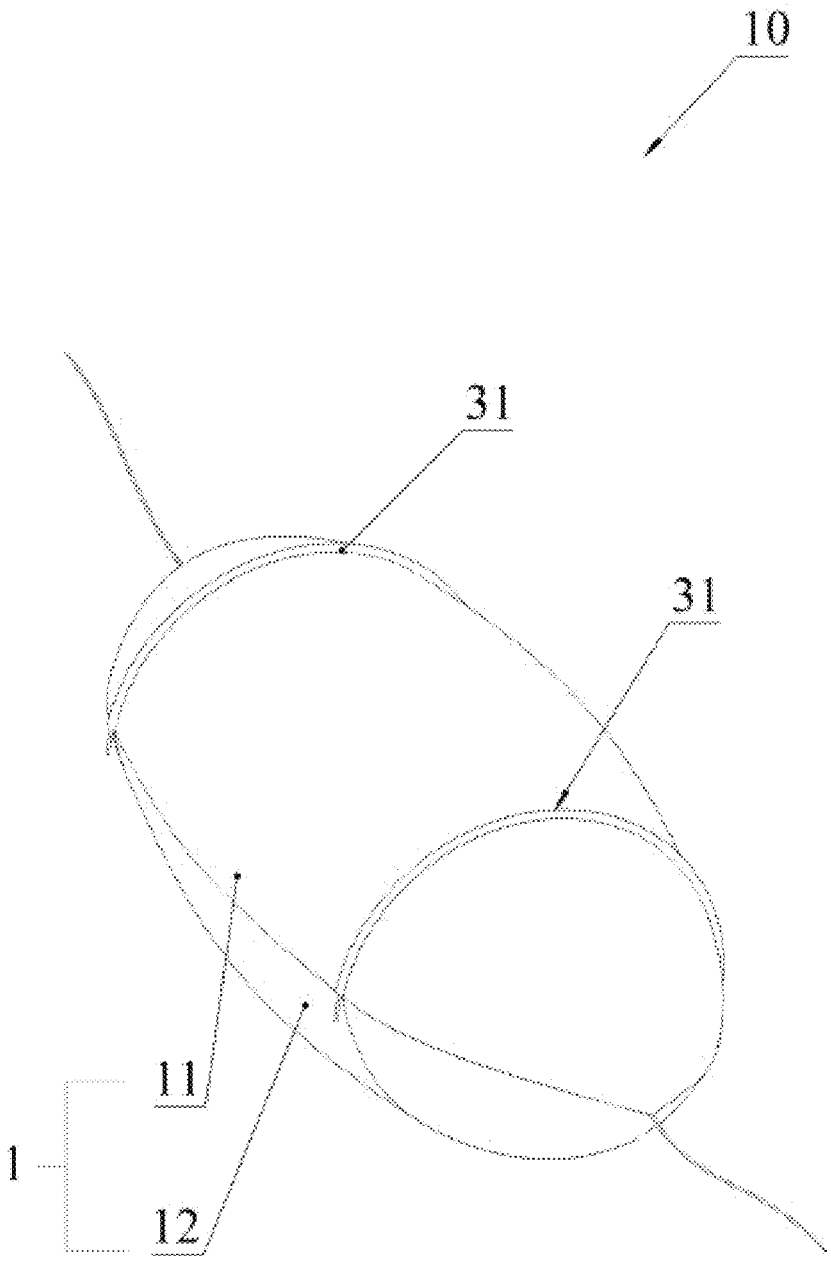
FIG. 5 is a perspective view of another embodiment provided by the present disclosure.
Figure 6:
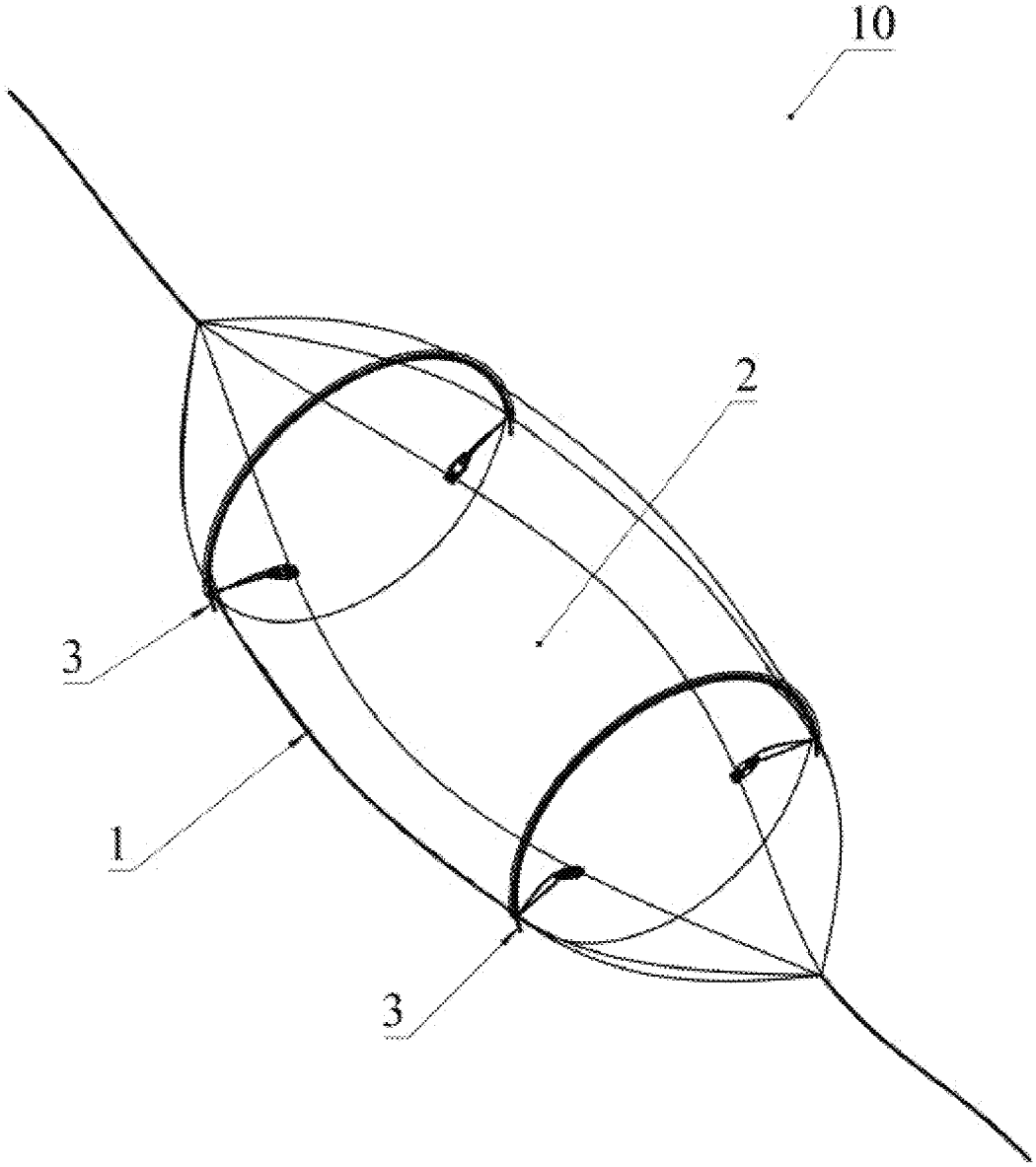
FIG. 6 is another perspective view of the embodiment shown in FIG. 5.
Figure 7:
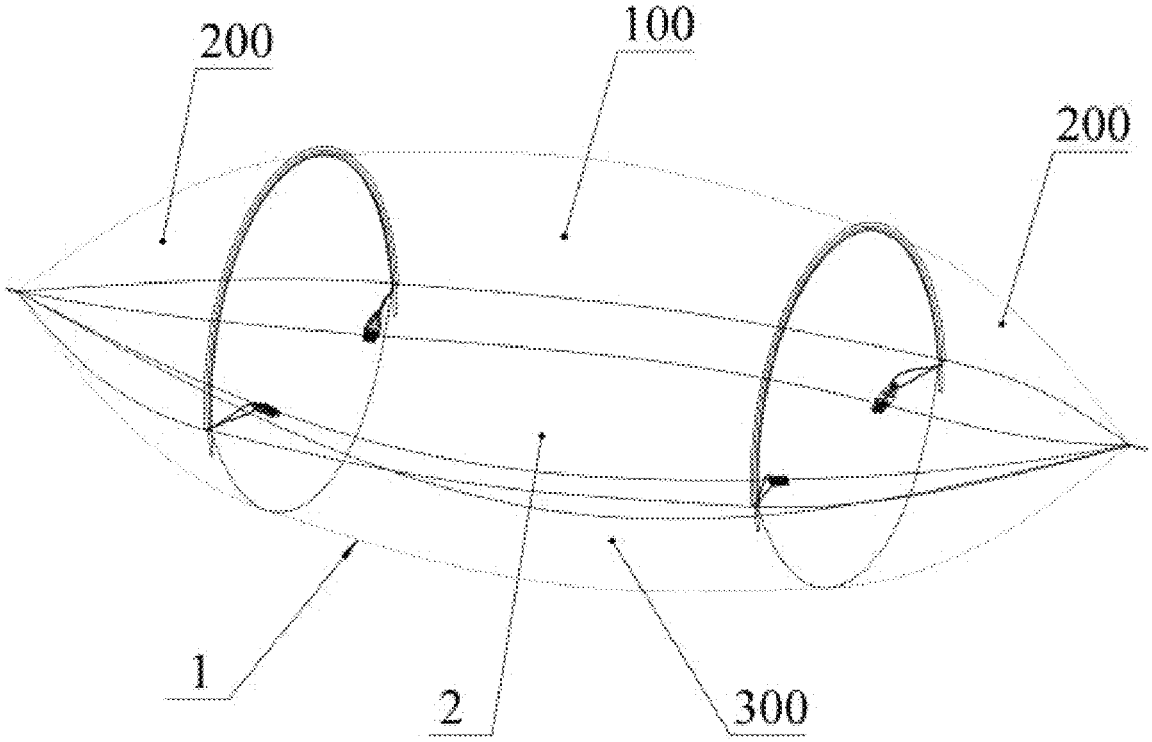
FIG. 7 is a structural schematic of the embodiment shown in FIG. 5.
Figure 8:
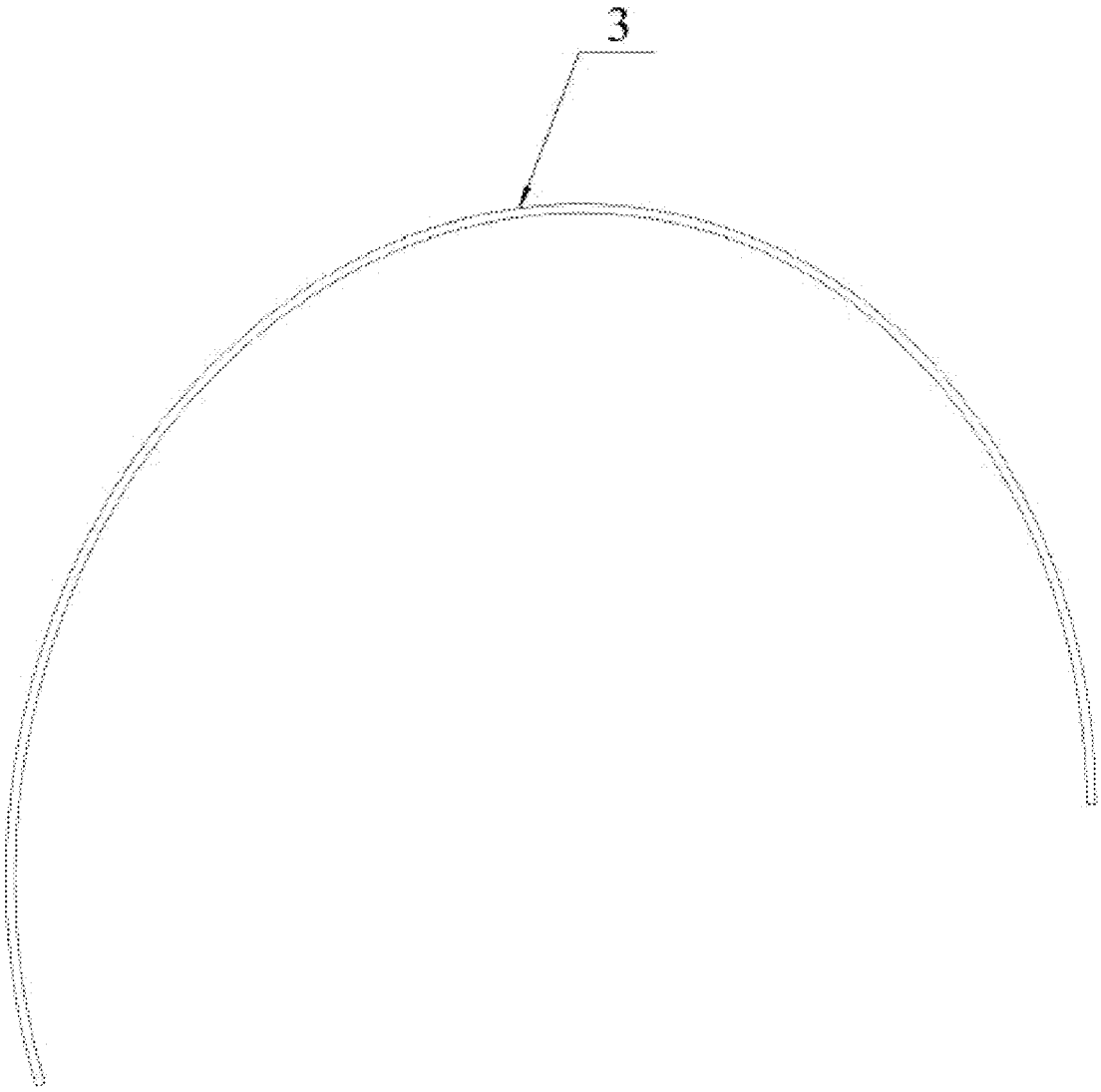
FIG. 8 is a perspective view of the supporting member in the embodiment shown in FIG. 5.

As shown in FIGS. 1 and 4, the present disclosure discloses a mosquito-repelling cover for an outdoor hammock, including a mosquito-repelling cover 1, a hammock body 2, a supporting member 3, and a connecting fastener 4. The mosquito-repelling cover 1 is made of high-density mosquito netting and is detachably fitted around the peripheral side of the hammock body 2 in an inner-outer sleeve configuration. The length and width of the mosquito-repelling cover 1 match the unfolded dimensions of the hammock body 2, ensuring complete coverage of the hammock body 2 during use to avoid blind spots in protection. The supporting member 3 is preferably a circular steel ring-shaped support frame with preset rigidity, configured in two sets spaced along the length of the hammock body 2. By supporting key points on the inner or peripheral side of the mosquito-repelling cover 1, it forms uniformly a distributed interval space between the mosquito-repelling cover 1 and the hammock body 2. The interval space prevents the mosquito-repelling cover 1 and hammock body 2 from adhering due to their own weight or user pressure while providing movement allowance for the user. The connecting fastener 4, serving as the core anti-tipping component, is arranged in a plurality of sets correspondingly distributed at the load-balancing points of the hammock body 2 (preferably at the four corners). One end is fixedly connected to the supporting member 3, while the other end is detachably connected to the hammock body 2. By establishing a rigid constraint between the hammock body 2 and the supporting member 3, it limits lateral displacement of the hammock body 2, maintaining relative stability between the hammock body 2 and the mosquito-repelling cover 1, effectively reducing the risk of tipping caused by user movements like turning over or sitting up.

In other embodiments (not shown), the supporting member 3 can be replaced with a support assembly composed of inflatable air beams. These air beams are made of wear-resistant elastic material and equipped with quick-inflation/deflation valves. During use, the air beams are inflated to a preset pressure through a hand pump or small electric pump to provide the required supporting force on the inner or peripheral side of the mosquito-repelling cover 1, thereby creating a widening space 100 and a narrowing space 200 similar to the aforementioned circular steel rings. After deflation, the air beams quickly soften and fold flat, significantly reducing storage volume for easy portability. Additionally, the inflatable air beams inherently possess cushioning and deformation capabilities, absorbing some impact energy when users get on or move, thereby mitigating shock transmission, enhancing comfort, and reducing the risk of injury from rigid metal components.

Figure 2:
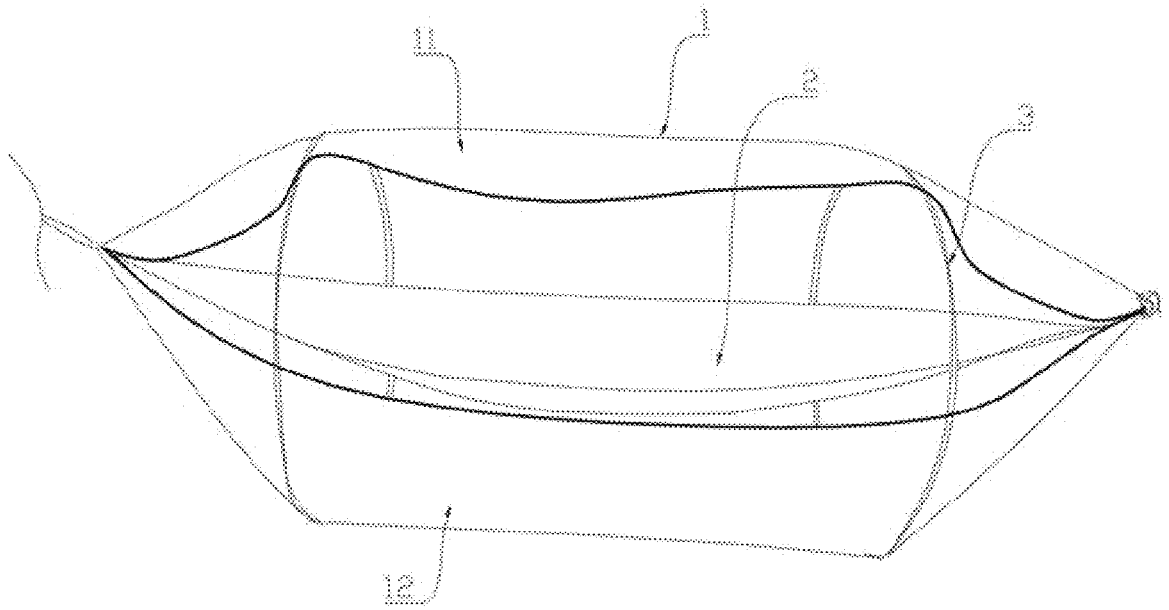
FIG. 2 is another perspective view of the embodiment in FIG. 1.

In the technical solution of the present disclosure, referring to FIG. 2, after the hammock body 2 is suspended and installed through ropes at both ends, the supporting member 3 acts on the mosquito-repelling cover 1 by "pushing outward from the inner side of the mosquito-repelling cover 1"—this pushing method ensures the supporting force of the supporting member 3 is evenly distributed to the periphery of the mosquito-repelling cover 1. Except for the connecting parts at both ends of the mosquito-repelling cover 1, which are designed to accommodate the hammock ropes, the top, side, and bottom areas of the mosquito-repelling cover 1 maintain an effective spacing from the hammock body 2. This spacing fully covers the area directly below the hammock body 2 (i.e., the space beneath the bearing surface of the hammock body 2). On one hand, this spacing design prevents the mosquito-repelling cover 1 and the hammock body 2 from partially adhering due to self-weight sagging or user pressure, eliminating the risk of mosquitoes entering through gaps. On the other hand, by covering the area directly below the hammock body 2, a closed-loop protective range is formed, encompassing the user's torso area and the space beneath the hammock. This not only blocks airborne mosquitoes from biting the user but also prevents ground-dwelling pests like snakes, insects, and ants from crawling into the protected area along the underside of the hammock body 2, achieving comprehensive protection for the user.

In the preferred embodiment of the present disclosure, referring to FIG. 1, the mosquito-repelling cover 1 and the hammock body 2 are completely separated (with no partial contact areas) through the pushing action of the supporting member 3. To specifically address the issue of the hammock body 2 tipping sideways, the connecting fasteners 4 (see FIG. 4) are set to four in number and arranged in one-to-one correspondence with the four corner stress points of the hammock body 2 (these corner points are key support points for the hammock body 2's lateral balance). The connecting fasteners 4 adopt a fixation clamp structure made of lightweight rigid material. One end forms a stable connection with the supporting member 3, while the other end forms a detachable clamping fit with the hammock body 2 through a gripping head featuring an anti-slip pattern. In the clamped state, the friction and rigid constraint between the gripping head and the hammock body 2 limit the lateral displacement of the hammock body 2. For detachment, only the elastic component of the gripping head needs to be operated, facilitating the separate storage of the mosquito-repelling cover 1 and the hammock body 2. Through the coordinated action of these four-corner fixation clamps, a rigid balance constraint relationship is established between the hammock body 2 and the supporting member 3, effectively maintaining the relative stability of the hammock body 2 and the mosquito-repelling cover 1. This significantly reduces the risk of the hammock body 2 tipping sideways due to user movement-induced center-of-gravity shifts.

In other embodiments (not shown), besides the aforementioned fixation clamp, the connecting fastener 4 can also employ flexible connectors to achieve detachable connection and lateral restraint between the mosquito-repelling cover 1 and the hammock body 2. Specifically, flexible ropes (such as nylon or polyester ropes), flexible straps (such as canvas or synthetic fiber webbing), or flexible fabric strips (such as high-wear-resistant cotton-linen strips or composite synthetic fabric strips) can be selected. One end of these flexible connecting fasteners is secured to the preset connection points on the supporting member (e.g., hanging rings on the outer periphery of the supporting member or reinforced fabric loops on the edge of the mosquito-repelling cover) using a double-thread stitching process. The other end is connected to the hammock body through compatible detachable structures, such as knots (e.g., bowline or butterfly knots) for flexible ropes, or hook-and-loop fasteners, snap buttons, or adjustable eyelets for flexible straps and fabric strips. Regardless of the type of connecting fastener used, a lateral constraint relationship between the hammock body 2 and the mosquito-repelling cover 1 can be established, effectively limiting lateral displacement of the hammock body 2 and ensuring its anti-tipping function.

In other embodiments (not shown), to further mitigate instantaneous impacts caused by user actions such as getting into bed, turning over, or sitting up, and to reduce the likelihood of tipping triggered by such actions, a buffer damping device can be integrated into the connecting fastener 4. Specifically, each clamping end of the connecting fastener 4 can be equipped with rubber pads, elastomeric bushings, or spring buffer structures. This damping device absorbs and gradually releases energy during clamping and force transmission, thereby suppressing the lateral displacement speed and instantaneous acceleration of the hammock body 2, achieving better anti-tipping performance.

As shown in FIG. 1, the interval space between the mosquito-repelling cover 1 and the hammock body 2 serves as the mosquito-repelling space. Specifically, the supporting member 3 includes two sets, configured to be arranged at both ends of the hammock body 2 along its length direction, dividing the mosquito-repelling space into a central widening space 100 and two side narrowing spaces 200. The widening space 100 corresponds to the main usage area of the hammock body 2, i.e., the core activity zone for the user's torso. The mosquito-repelling cover 1 around this area remains parallel to the hammock body 2 under the balanced support of the supporting member 3, ensuring uniform distribution of height and width along the hammock's length direction, thereby providing stable activity allowance for the user. The narrowing spaces 200 correspond to the non-core usage areas at both ends of the hammock body 2. The mosquito-repelling cover 1 around these areas, under the traction of the two sets of supporting members 3 and their own tension, inclines and converges toward the center of the hammock body 2. The convergence angle matches the support radius of the supporting member 3, forming an integrated enclosed structure of "central cylindrical widening space 100+conical narrowing spaces 200 on both sides" for the mosquito-repelling space.

As shown in FIG. 2, the mosquito-repelling cover 1 further includes an upper net section 11 and a lower net section 12 divided along the height direction, which can be opened or closed through a zipper structure (single or double-sided). The materials of the upper net section 11 and lower net section 12 can be independently selected based on usage scenarios: the upper net section 11 may use sealed waterproof nylon (for rain protection to prevent the hammock body 2 from getting wet), Oxford light-shielding fabric (for bright light environments to reduce light intensity inside the mosquito-repelling cover 1 and enhance rest comfort), or PVC transparent film (for scenic viewing, allowing users to observe outdoor environments). The lower net section 12 preferably uses abrasion-resistant mesh (for ground contact scenarios to extend service life). When different materials are used for the upper net section 11 and lower net section 12, the mosquito-repelling cover 1 can be flipped 180° around the lengthwise axis of the hammock body 2. By adjusting the vertical positions of the upper net section 11 and lower net section 12, the top material can match real-time weather conditions (e.g., placing the light-shielding material upward on sunny days and the waterproof material upward on rainy days), achieving functional adaptability.

Figure 3:
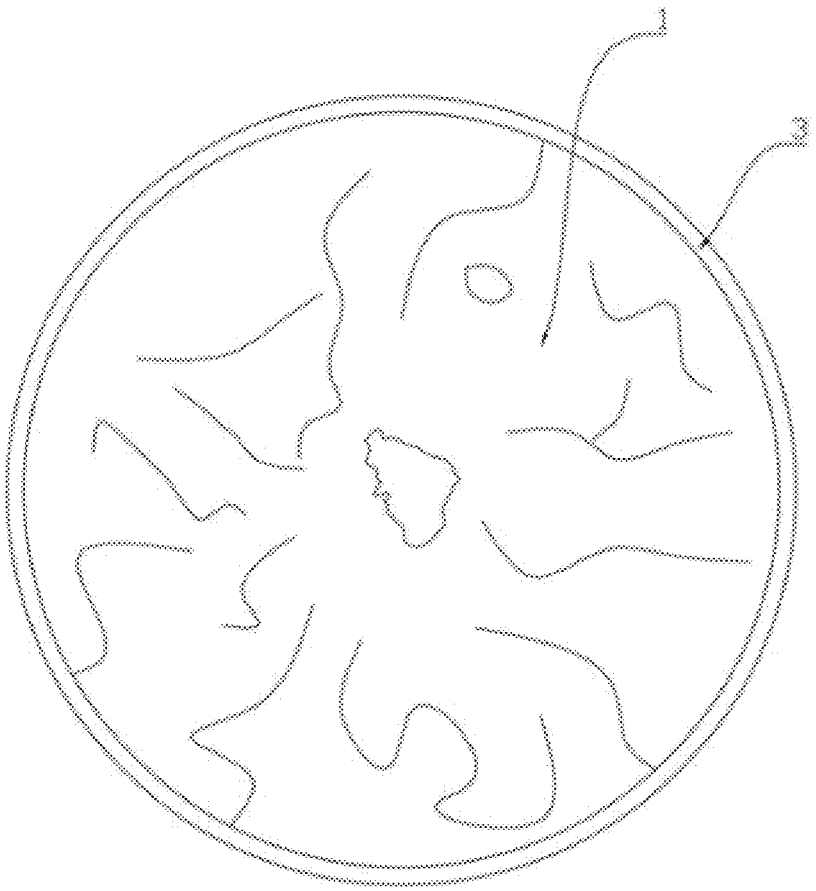
FIG. 3 is a schematic diagram of the folded state of the mosquito-repelling cover for the hammock in the embodiment shown in FIG. 1.

As shown in FIG. 3, for the storage design of the circular steel ring-shaped supporting members 3, the two sets of supporting members 3 are fixedly connected to the reinforced fabric pieces at both ends of the mosquito-repelling cover 1, forming a structural configuration of "rigid support at both ends+flexible connection in the middle." When the hammock needs to be folded, there is no need to disassemble the supporting members 3. Simply remove the suspension ropes at both ends of the hammock, and using the two sets of circular steel ring-shaped supporting members 3 as positioning references, fold the mosquito-repelling cover 1 and the hammock body 2 toward the middle along the length direction. The rigidity of the supporting members 3 ensures the stability of the folded shape, preventing the mosquito-repelling cover 1 mesh fabric from tangling with the hammock body 2. This not only facilitates quick organization and storage but also ensures that the overall structure remains untangled and knot-free when unfolded next time, enhancing ease of use.

Please also refer to FIGS. 5, 6, 7, and 8. In other embodiments of the present disclosure, to meet the lightweight storage requirements for outdoor use, the supporting members 3 can adopt a semicircular steel ring-shaped support frame. Correspondingly, the mosquito-repelling cover 1 is provided with semicircular installation channels 31 at both ends along its length direction. These installation channels 31 are arranged annularly along the outer surface of the mosquito-repelling cover 1, and the supporting members 3 are threaded through the installation channels 31 to fixedly connect with the mosquito-repelling cover 1, ensuring that the mosquito-repelling cover 1 can be stably propped up to form the aforementioned widening space 100 and narrowing space 200. In this embodiment, the mosquito-repelling cover also includes an upper net section 11 and a lower net section 12. The materials of the upper net section 11 and lower net section 12 can be the same or different. The upper net section 11 and the hammock body 2 form the widening space 100 and narrowing space 200, ensuring users have sufficient room for movement during use and preventing restriction by the mosquito-repelling cover. The lower net section 12, due to the weight of the net cover itself, forms a protective space 300 with the hammock body 2 to prevent mosquito bites on the lower part of the hammock body 2 or the ground. The storage method for the semicircular supporting members 3 is as follows: when storage is needed, the semicircular steel ring-shaped supporting members 3 can be pulled out and disassembled from the installation channels 31. After disassembly, the mosquito-repelling cover 1 can be completely folded, significantly reducing storage volume for easy carrying and storage.

In other embodiments (not shown), the two ends of the semicircular steel ring-shaped supporting member 3 are provided with several clamping grooves or circumferential limiting slots on their outer periphery or cross-section. Correspondingly, the mosquito-repelling cover 1 is equipped with an embeddable metal ring, plastic ring, or reinforcement strip on the inner installation channel or the edge in contact with the supporting member. During installation, the metal ring or reinforcement strip is inserted into the clamping groove of the supporting member and pushed axially to the limiting position, thereby achieving snap-fit limiting and preventing relative sliding or rotation of the supporting member during use. This snap-fit limiting structure can be fixed with a simple snapping action, eliminating the need for additional fastening tools.

In other embodiments (not shown), the supporting member 3 may adopt a ring-shaped support frame composed of a plurality of segments, each being an independent curved component with detachable connecting mechanisms (such as snaps, pins, or threaded joints) between adjacent segments. During use, the segments are assembled and locked in sequence to form a complete circular or semicircular support ring for the lifting function. For storage, simply unlocking the connecting mechanisms allows the ring to be disassembled into several short sections, significantly reducing the length of individual segments, making it easy to fit into standard-sized storage bags or backpacks. This multi-segment design also allows for adjustable support radius (by replacing segments of different lengths) to accommodate hammocks of various models or sizes, enhancing product versatility and modular maintenance convenience.

Figure 9:
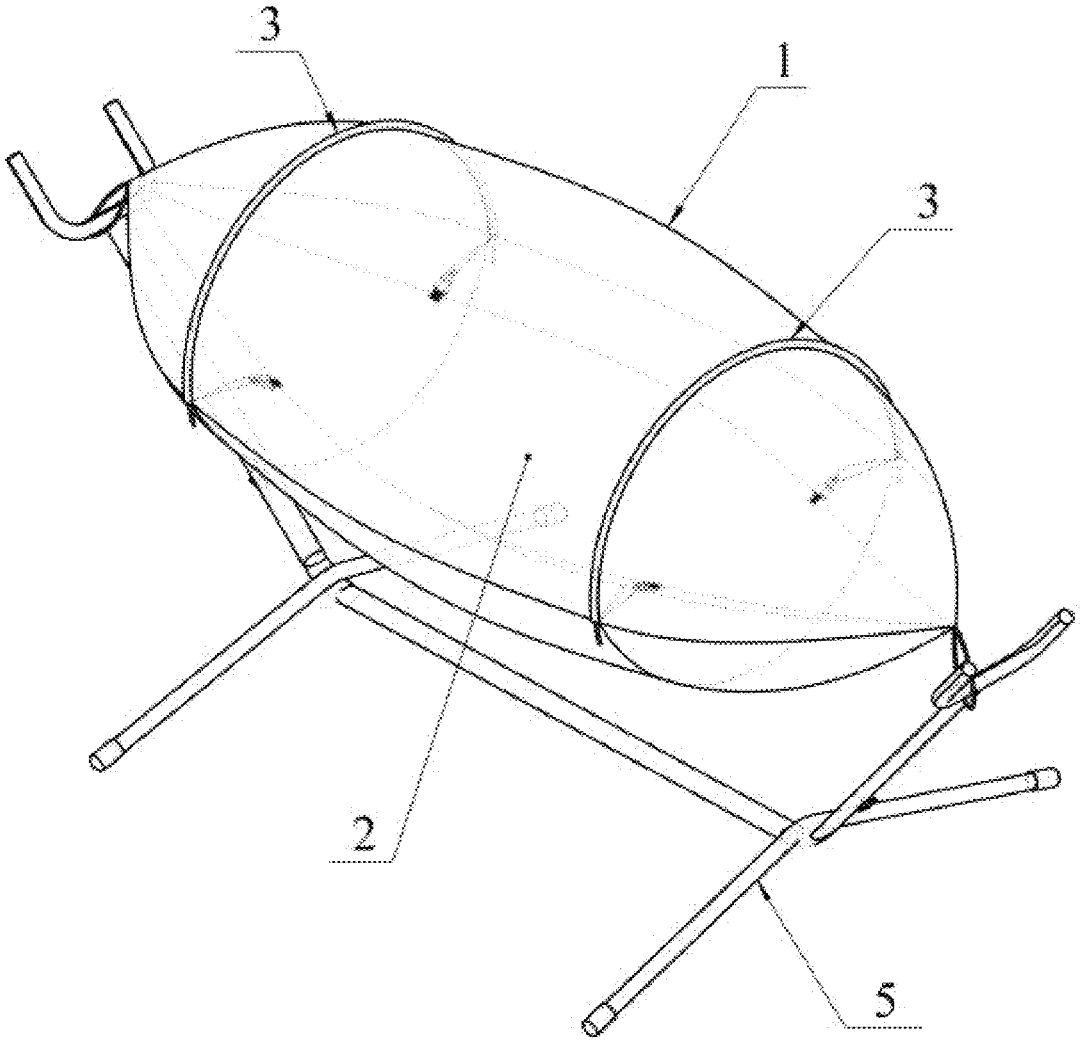
FIG. 9 is a perspective view of yet another embodiment provided by the present disclosure.

In other embodiments, as shown in FIG. 9, in scenarios requiring higher stability or where high suspension installation is inconvenient (e.g., patios, lawns with limited mounting points), an integrated support frame 5 can be installed as a shared load-bearing structure for both the hammock body 2 and the mosquito-repelling cover 1. The support frame 5 is an independent metal or composite material frame, configured as an open load-bearing structure consisting of two vertical columns and a crossbeam. Both ends of the hammock body 2 and the mosquito-repelling cover 1 are fixed to the crossbeam of the support frame 5 through suspension ropes, achieving overall rigid support. Using an independent support frame eliminates reliance on trees or existing mounting points in the environment. The support frame 5 can be designed as a foldable or detachable structure for easy transport and storage. For camping tents or platform usage scenarios, the support frame 5 can also be designed to work with ground stakes or self-weight modules to enhance wind resistance and lateral stability.

In summary, the present disclosure achieves the following technical effects:

Through the detachable inner and outer sleeve structure of the mosquito-repelling cover 1 and the hammock body 2, combined with the supporting effect of the supporting member 3, the mosquito-repelling cover 1 and the hammock body 2 form a uniform interval space covering directly below the hammock. This prevents the two from adhering due to their own weight or user pressure, effectively blocking airborne mosquito bites and preventing ground-based snakes, insects, rodents, and ants from intruding, achieving comprehensive protection. By arranging connecting fasteners 4 (lightweight rigid fixation clamps) along the four corners of the hammock body 2, a rigid constraint relationship is established between the hammock body 2 and the supporting member 3, limiting lateral displacement of the hammock to prevent tipping and enhance stability during use. The split design of the upper net section 11 and lower net section 12, along with multi-material options (waterproof/light-blocking/transparent/wear-resistant materials), combined with the 180° flipping function of the mosquito-repelling cover 1 around the hammock axis, enables adaptation to various weather scenarios such as rain protection, sun shading, and sightseeing. The semi-circular installation channel 31, designed to fit the semi-circular supporting member 3, allows the supporting member to be pulled out and detached. Once removed, the mosquito-repelling cover 1 can be fully folded, significantly reducing storage volume and improving portability for outdoor use. Additionally, the widening space 100 created by the supporting member 3 corresponds to the main usage area of the hammock, ensuring ample room for users to turn or sit up, thereby eliminating spatial constraints and enhancing comfort.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A mosquito-repelling cover assembly for an outdoor hammock, comprising:

a mosquito-repelling cover sleeved over a peripheral side of a hammock body;

at least one supporting member fixedly connected to the mosquito-repelling cover; and a plurality of connecting fasteners fixedly connected to the mosquito-repelling cover and detachably connected to the hammock body;

wherein the at least one supporting member is configured to support an interval space between the mosquito-repelling cover and the hammock body when the mosquito-repelling cover is sleeved over the hammock body, preventing the mosquito-repelling cover from contacting a bearing surface of the hammock body; and the plurality of connecting fasteners detachably connect the mosquito-repelling cover to the hammock body at discrete connection points distributed around a periphery of the hammock body, restraining lateral movement of the hammock body relative to the mosquito-repelling cover during connection;

wherein each of the plurality of connecting fasteners is a fixation clamp, with one end fixed to the at least one supporting member and another end capable of clamping or detaching from the hammock body through a gripping head.

2. The mosquito-repelling cover assembly for an outdoor hammock according to claim 1, wherein there are two supporting members spaced apart along a length direction of the hammock body.

3. The mosquito-repelling cover assembly for an outdoor hammock according to claim 2, wherein the two supporting members divide the interval space into a widening space corresponding to a central region of the hammock body and two narrowing spaces corresponding to end regions of the hammock body.

4. The mosquito-repelling cover assembly for an outdoor hammock according to claim 1, wherein the mosquito-repelling cover comprises an upper section and a lower net section, and a zipper structure is arranged between the upper section and the lower net section for opening and closing.

5. The mosquito-repelling cover assembly for an outdoor hammock according to claim 4, wherein the upper section is made of any one of a sealed waterproof material, a light-shielding material, or a transparent material.

6. The mosquito-repelling cover assembly for an outdoor hammock according to claim 4, wherein the lower net section is made of abrasion-resistant mesh.

7. The mosquito-repelling cover assembly for an outdoor hammock according to claim 1, wherein there are four connecting fasteners, each detachably connected to one of four corners of the hammock body.

8. A mosquito-repelling cover assembly for an outdoor hammock, comprising:

a mosquito-repelling cover sleeved over a peripheral side of a hammock body;

at least one supporting member configured as a rigid annular support frame, the at least one supporting member being fixedly connected to the mosquito-repelling cover; and a plurality of connecting fasteners fixedly connected to the mosquito-repelling cover and detachably connected to the hammock body;

wherein the at least one supporting member is configured to support an interval space between the mosquito-repelling cover and the hammock body when the mosquito-repelling cover is sleeved over the hammock body, preventing the mosquito-repelling cover from contacting a bearing surface of the hammock body; and the plurality of connecting fasteners are configured to detachably connect the mosquito-repelling cover to the hammock body at a plurality of discrete connection points distributed around a periphery of the hammock body to restrain lateral movement of the hammock body relative to the mosquito-repelling cover during connection;

wherein each of the plurality of connecting fasteners is a fixation clamp, with one end fixed to the at least one supporting member, and another end capable of clamping or detaching from the hammock body through a gripping head.

9. The mosquito-repelling cover assembly for an outdoor hammock according to claim 8, wherein there are two supporting members spaced apart along a length direction of the hammock body; and the two supporting members divide the interval space into a widening space corresponding to a central region of the hammock body and two narrowing spaces corresponding to end regions of the hammock body.

10. The mosquito-repelling cover assembly for an outdoor hammock according to claim 8, wherein there are four connecting fasteners, each detachably connected to one of four corners of the hammock body.

11. The mosquito-repelling cover assembly for an outdoor hammock according to claim 8, wherein an end of each of the plurality of connecting fasteners that clamps the hammock body is a gripping head with anti-slip patterns.

12. A mosquito-repelling cover assembly for an outdoor hammock, comprising:

a mosquito-repelling cover sleeved over a peripheral side of a hammock body;

at least one supporting member configured as a rigid semi-annular support frame, the at least one supporting member being fixedly connected to the mosquito-repelling cover; and a plurality of connecting fasteners fixedly connected to the mosquito-repelling cover and detachably connected to the hammock body;

wherein the at least one supporting member is configured to support an interval space between the mosquito-repelling cover and the hammock body when the mosquito-repelling cover is sleeved over the hammock body, preventing the mosquito-repelling cover from contacting a bearing surface of the hammock body; and the plurality of connecting fasteners are configured to detachably connect the mosquito-repelling cover to the hammock body at a plurality of discrete connection points distributed around a periphery of the hammock body to restrain lateral movement of the hammock body relative to the mosquito-repelling cover during connection;

wherein each of the plurality of connecting fasteners is a fixation clamp, with one end fixed to the at least one supporting member and another end clamping or detaching from the hammock body through a gripping head with anti-slip patterns.

13. The mosquito-repelling cover assembly for an outdoor hammock according to claim 12, wherein the mosquito-repelling cover is provided with a semi-circular installation channel, and the at least one supporting member is threaded through the installation channel.

14. The mosquito-repelling cover assembly for an outdoor hammock according to claim 12, wherein the mosquito-repelling cover comprises an upper net section and a lower net section, with a zipper structure arranged between the upper net section and the lower net section for opening and closing.

15. The mosquito-repelling cover assembly for an outdoor hammock according to claim 14, wherein the upper net section and the hammock body form a central widening space and narrowed spaces at both ends.

16. The mosquito-repelling cover for the outdoor hammock according to claim 14, wherein the lower net section and the hammock body form a lower protective space.

17. The mosquito-repelling cover assembly for an outdoor hammock according to claim 12, wherein there are four connecting fasteners, each detachably connected to one of four corners of the hammock body.

* * * * *